US005435931A

United States Patent [19]

Kim et al.

[11] Patent Number: 5,435,931

[45] Date of Patent: Jul. 25, 1995

[54] PROTEIN ENHANCED ELECTRORHEOLOGICAL FLUIDS

[75] Inventors: Sangtae Kim, Shorewood Hills; Daniel J. Klingenberg, Stoughton, both of Wis.

[73] Assignee: Wisconsin Alumni Research Foundation, Madison, Wis.

[21] Appl. No.: 147,709

[22] Filed: Nov. 4, 1993

[51] Int. Cl.[6] ..... C10M 171/00; C09K 3/00

[52] U.S. Cl. ..... 252/75; 252/76; 252/77; 252/79; 252/572

[58] Field of Search ..... 252/572, 75, 76, 77, 252/79

[56] References Cited

U.S. PATENT DOCUMENTS

| | | | |
|---|---|---|---|
| 3,970,573 | 7/1976 | Westhaver | 252/73 |
| 4,502,973 | 3/1985 | Stangroom | 252/73 |
| 4,744,914 | 5/1988 | Filisko et al. | 252/74 |
| 4,782,927 | 11/1988 | Sproston et al. | 192/21.5 |
| 4,812,251 | 3/1989 | Stangroom | 252/75 |
| 4,992,192 | 2/1991 | Ahmed | 252/73 |
| 4,994,198 | 2/1991 | Chung | 252/78.3 |
| 5,032,307 | 7/1991 | Carlson | 252/73 |
| 5,032,308 | 7/1991 | Knobel et al. | 252/74 |

OTHER PUBLICATIONS

L. Gindin, et al., "New data on electrical breakdown of suspensions of aluminum in dielectrics", English Translation of Doklady Akademii Nauk SSSR, 162(4):839–842, Jun. 1965.

L. Gindin, et al., "A structure formation of (the) disperse systems in an electric field", *Uspekhi Khim.*, 37(1);130–142 (1968), Plus partial translation.

Electrorheological (ER) Fluids, A Research Needs Assessment, Final Report, U.S. Department of Energy, May 1993.

D. J. Klingenberg, "Simulation of the dynamic oscillatory response of electrorheological suspensions . . . ", *J. Rheol.*, 37(2):199–214, Mar./Apr. 1993.

R. Pool, "Fluids with a case of split personality", *Science*, 247:1180–81, Mar. 9, 1990.

D. L. Hartsock, et al., "ER fluid requirements for automotive devices", *J. Rheol.*, 35(7):1305–1326 (1991).

*Primary Examiner*—Christine Skane
*Attorney, Agent, or Firm*—Quarles & Brady

[57] ABSTRACT

An enhanced ER fluid is disclosed. Polypeptides such as proteins are added to ER fluids. The ER response, particularly increased viscosity in response to an electric potential difference applied to the fluid, is enhanced.

4 Claims, No Drawings

PROTEIN ENHANCED ELECTRORHEOLOGICAL FLUIDS

FIELD OF THE INVENTION

The present invention relates generally to fluids which exhibit substantial increases in viscosity when exposed to electric fields. More specifically, the invention relates to the use of a polypeptide to enhance this and other electroheological effects of such fluids.

BACKGROUND OF THE INVENTION

Electrorheological ("ER") fluids are fluids which exhibit substantial increases in viscosity in the presence of an electric field. Electrorheological fluids typically consist of a very low conductivity carrier fluid and a suspended particle component.

These fluids have previously been known by various names such as electrofluids, electroviscous fluids, electroresponsive fluids, electrorestrictive fluids, and jammy fluids. They are now most commonly referred to as "electrorheological" fluids because in addition to viscosity changes applied electrical fields can cause substantial changes in the overall rheology of the fluids.

The most commercially desirable ER fluids exhibit large, reversible electrorheological effects. In the absence of an electric field, these ER fluids exhibit Newtonian flow properties such that the shear stress (applied force per unit area) is directly proportional to the shear rate applied (relative velocity per unit thickness). When an electric field is applied, a yield stress phenomenon appears and no shearing takes place until the shear stress exceeds a minimum yield value which increases with increasing field strength, i.e. the fluid appears to behave like a Bingham plastic. This phenomenon appears as an increase in apparent viscosity of several orders of magnitude.

ER fluids change their viscosity characteristics very rapidly when electric fields are applied or released. The ability of ER fluids to respond this rapidly makes them highly desired elements in certain electro-mechanical devices. For example, ER fluids have applications in electro-mechanical clutches, fluid-filled engine mounts, coupling devices in robotic systems, automatic vehicle shock absorbers, and active dampers for vibration control. See e.g. U.S. Pat. No. 4,782,927. The disclosure of this patent, and of all other publications referred to herein, are incorporated by reference as if fully set forth herein.

For a discussion of the use of ER fluids in automotive devices, see generally D. L. Hartsock, et al. 35 *J. Rheol.* 1305–1326 (1991). For a general discussion of ER fluids, see R. Pool, 247 *Science* 1180–1181 (1990); U.S. Pat. No. 4,992,192; U.S. Pat. No. 5,032,307; and U.S. Pat. No. 5,032,308. For a discussion of the relaxation mechanism of ER fluids see D. Klingenberg, 37 *J. Rheol.* 199–214 (1993). See also U.S. Pat. Nos. 4,744,914 (zeolite particles); 4,994,198 (silicone particles); 4,502,973 (halogenated liquids); and 4,812,251 (fluorosilicone liquids).

Various problems have slowed the commercialization of ER fluids. One problem is the very high cost of certain components that are sometimes used to enhance the effect. Another problem is that for some applications there may be too small a viscosity response for a given electric field. For example, the automotive industry is interested in ER fluids for inter alia electrically controlled shock absorbers that continously stiffen and relax in response to changing road conditions. The electrical power used must be kept to the minimum (to avoid battery drain and heat dissipation problems), while the changes needed in viscosity to achieve the functions are great.

SUMMARY OF THE INVENTION

We have found that the use of polypeptides (particularly large proteins) in ER fluids results in a marked enhancement of ER response. In one aspect the invention provides an ER fluid comprising a liquid, a polypeptide, and porous particles dispersed in the liquid. The pores of the particles are sized so as to be capable of receiving at least a part of the polypeptide inside a pore. The fluid is such that an electrostatic potential difference provided across the fluid can increase the viscosity of the fluid to a greater extent than the increase in viscosity would be if the fluid did not contain the polypeptide.

The liquid of the present invention is preferably a very low conductivity liquid (e.g. an oil) having a low dielectric constant.

Preferably, the protein is of a type that strongly interacts with high valence ions (e.g. $Ca^{+2}$). Examples of such proteins are the caseins.

If desired, the protein can be pre-imbedded in the particles prior to insertion in the liquid such that the protein would occupy the volume enclosed by the outer surface of the particles. This is nevertheless intended to be treated as a "porous" particle for purposes of this application.

If desired, the particles can have a diameter of between 0.05 μm and 100 μm, the volume fraction of particles can be between 0.05 and 0.5; and the carrier liquid can have a viscosity of between 0.001 Pa*s and 10 Pa*s. The preferred weight % of the protein in the fluid is usually between 0.01% and 1%.

A primary object of the invention is to provide an enhanced ER fluid.

Another object is to increase the ER response using a low cost, readily available component.

Another object is to provide ER fluids that are more suitable for certain uses.

These and still other objects and advantages of the present invention will be apparent from the description below.

DESCRIPTION OF PREFERRED EMBODIMENTS

Materials

The following examples illustrate several enhanced ER fluids of the present invention. Silicone oil (Dow SF96) was used as the preferred low conductivity carrier. Other liquids that could be used for the continuous liquid phase are other oils (for example, corn oil; mineral oil), kerosene, and halogenated hydrocarbons. Preferred ER fluids include those having large field-induced yield stress, low conductance, colloidal stability, and which are environmentally benign.

The following porous particles were used: neutral aluminum oxide particles with a particle diameter of 43–65 microns; latex particles with a particle diameter of 90 microns; and zeolite particles. Other porous particles which can be used for ER fluids are flour, silica, ion exchange resins, polymethacrylate, and polyaniline. Preferably, the particle size is 0.05 micron to 100 micron, with some of the pores being at least 60 Angstroms. Particles are stored in desiccators to limit the amount of adsorbed water.

The following polypeptides were used as example ER fluid enhancers: α-lactalbumin (AL); β-lactoglobulin (BLG); α-casein (AC); κ-casein (KC); albumin bovine fraction V (ALB), 2% other globulins (AB1); albumin bovine, globulin free (AB2); albumin bovine, 99% pure (AB3); albumin chicken, fraction V powder (AC1); albumin chicken, 99% pure (AC2); and soy protein mixture, 80% pure (SP). Proteins were kept in a refrigerator as directed by the instructions of the supplier to minimize denaturing.

The porous particles preferably occupy a fluid volume fraction of from 0.05 to 0.50. The viscosity of the liquid continuous phase (by itself) is preferably from 0.001 Pa*s to 10 Pa*s. The ER fluid viscosity of the present invention preferably increases in response to an electric field somewhere between 0.5 kV/mm to 5 kV/mm, albeit use of larger field strengths are also possible.

Procedure

Various small protein amounts (e.g. 0.01–1.0 weight % of the fluid) were added to about 4 grams of the silicone oil and dispersed as much as possible. The porous particles were then added to make 20 weight percent particle concentration in the ER fluid composition. The ER fluid samples were kept in a desiccator for at least 24 hours.

Because the proteins are hydrophilic molecules, they do not dissolve in the oil. Rather, they disperse and make a cloudy suspension after many hours of mixing.

A Bohlin rheometer with parallel disk geometry was used to measure the stress-shear rate relationships. A parameter of interest was $\tau_o$, the dynamic yield stress of the suspension. A shear rate sweep in the approximate range of 3–5 to $10^{-2}$–$10^{-3}$ $s^{-1}$ was performed in a down and up fashion. The experiment was repeated as many times as needed to make the downward sweep match the upward sweep values.

The frequency was normally kept constant at 500 Hz (except Example 8), and the electric field was varied through typical ranges in ER fluid applications. The temperature was maintained at approximately 25° C.

Our belief is that in the presence of porous particles the proteins would adsorb on the outer particle surfaces and on surfaces within the particle pores. An adsorption experiment was performed that confirmed this. First, a known amount of a protein was dispersed in the oil. The protein solution was then divided into two parts. To one part, solid particles were added. The samples were mixed for a day. They were then kept still for half a day for the particles to settle. A known volume (2 ml) from each of the dispersed protein solution and suspension supernatant was then taken and added to a measured amount of deionized purified water (10 ml). The solutions were kept for half a day. The absorbance of the water compartment (relative to pure water) was then measured with a spectrophotometer to see the effect of the presence of particles on the concentration of the proteins in the oil medium. The proteins did adhere to the porous particles.

RESULTS

Example 1: Yield Stress Values for an $Al_2O_3$ Suspension (without protein). We believe that the uncertainty in the yield stress is approximately 0.01 Pa.

| 20% $Al_2O_3$ in Silicone Oil | | | |
|---|---|---|---|
| Electric Field Strength (V/mm) | | | |
| 0 (V/mm) | 500 (V/mm) | 1000 (V/mm) | 1500 (V/mm) |
| $\tau_o$ (Pa) | | | |
| 2.0 e-2 | 6.0 e-2 | 0.32 | 0.68 |

EXAMPLE 2: Yield Stress Values for an $Al_2O_3$ Suspension with BLG protein.

| 20% $Al_2O_3$ in Silicone Oil, BLG Added | | | | | | |
|---|---|---|---|---|---|---|
| | Electric Field Strength (V/mm) | | | | | |
| BLG wt % | 0 | 500 | 1000 | 1200 | 1300 | 1400 |
| | $\tau_o$ (Pa) | | | | | |
| 0.01 | 7.0 e-3 | 3.0 | 9.0 | 9.5 | 15 | 20 |
| 0.05 | 9.4 e-3 | 3.2 | 10 | 13 | 24 | 33 |
| 0.1 | 7.0 e-3 | 3.6 | 6.5 | 6.8 | 7.0 | 12 |
| 0.2 | 4.0 e-2 | 1.6 | 5.2 | 5.9 | 6.4 | 9.0 |
| 0.3 | 4.0 e-2 | 3.2 | 10 | 2.2 | 3.0 | 3.4 |
| 0.4 | 4.0 e-2 | 1.4 | 4.1 | 6.5 | 10 | 12 |
| 0.5 | 5.0 e-2 | 1.5 | 5.6 | 7.4 | 6.6 | 8.0 |

Conclusion: Protein enhances the ER effect, with small amounts preferred.

Example 3: Yield Stress Values for an $Al_2O_3$ Suspension with 0.1% BLG protein, albeit the suspension is made with non-dryed particles.

| 20% $Al_2O_3$ in Silicone Oil, 0.1% BLG Added | | | |
|---|---|---|---|
| Electric Field Strength (V/mm) | | | |
| 0 | 500 | 1000 | 1500 |
| $\tau_o$ (Pa) | | | |
| 6.0 e-2 | 3.8 | 10 | 30 |
| After Two Weeks | | | |
| 8.5 e-2 | 0.28 | 1.2 | 1.8 |
| After Four Weeks | | | |
| 5.0 e-2 | 0.28 | 0.90 | 1.8 |

Conclusion: Water can further enhance the protein ER effect.

Example 4: Yield Stress Values for an $Al_2O_3$ Suspension with ALB protein.

| 20% $Al_2O_3$ in Silicone Oil, ALB Added | | | |
|---|---|---|---|
| ALB | Electric Field Strength (V/mm) | | |
| wt % | 500 | 1000 | 1500 |
| | $\tau_o$ (Pa) | | |
| 0.01 | 2.0 | 7.0 | 10 |
| 0.05 | 1.3 | 3.0 | 8.5 |
| 0.1 | 0.45 | 2.0 | 4.0 |
| 0.2 | 0.6 | 2.5 | 5.0 |

Yield Stress Values for an $Al_2O_3$ Suspension with AB1; AB2 protein.

| | Electric Field Strength (V/mm) | | | | |
|---|---|---|---|---|---|
| | 0 | 500 | 1000 | 1250 | 1500 |
| | $\tau_o$ (Pa) | | | | |
| AB1 wt % | 20% $Al_2O_3$ in Silicone Oil, AB1 Added | | | | |
| 0.34 | 6.0 e-3 | 0.67 | 2.5 | 3.5 | 5.6 |
| 0.5 | 4.0 e-3 | 0.75 | 2.5 | 3.5 | 5.6 |
| 1.0 | 3.0 e-3 | 0.60 | 1.7 | 2.6 | 3.9 |
| AB2 wt % | 20% $Al_2O_3$ in Silicone Oil, AB2 Added | | | | |
| 0.2 | 1.3 e-2 | 1.6 | 5.5 | 5.5 | 11 |
| 0.5 | 7.0 e-2 | 1.0 | 8.1 | 10 | 21 |

-continued

| | Electric Field Strength (V/mm) | | | | |
|---|---|---|---|---|---|
| | 0 | 500 | 1000 | 1250 | 1500 |
| | $\tau_o$ (Pa) | | | | |
| 1.0 | 8.0 e-2 | 1.6 | 4.7 | 7.5 | 13 |

Yield Stress Values for an $Al_2O_3$ Suspension with AC1; AB3.

| | Electric Field Strength (V/mm) | | | | | |
|---|---|---|---|---|---|---|
| | 0 | 500 | 1000 | 1200 | 1400 | 1500 |
| | $\tau_o$ (Pa) | | | | | |
| AC1 wt % | 20% $Al_2O_3$ in Silicone Oil, AC1 Added | | | | | |
| 0.1 | 5.7 e-2 | 1.4 | 4.8 | 6.0 | 7.6 | 7.0 |
| 0.5 | 1.8 e-2 | 1.2 | 4.8 | 6.0 | 7.0 | 9.7 |
| 1.0 | 4.0 e-3 | 1.1 | 3.3 | 5.3 | 6.9 | 8.0 |
| AB3 wt % | 20% $Al_2O_3$ in Silicone Oil, AB3 Added | | | | | |
| 0.1 | 2.3 e-2 | 1.1 | 4.2 | 4.2 | 6.0 | 9.0 |
| 0.5 | 5.5 e-2 | 1.0 | 4.0 | 4.6 | 6.2 | 6.6 |
| 1.0 | 2.6 e-2 | 1.0 | 3.7 | 4.1 | 5.2 | 7.8 |

Yield Stress Values for an $Al_2O_3$ Suspension with AC2.

| | 20% $Al_2O_3$ in Silicone Oil, AC2 Added | | | | |
|---|---|---|---|---|---|
| | Electric Field Strength (V/mm) | | | | |
| AC2 wt % | 500 | 750 | 1000 | 1250 | 1500 |
| | $\tau_o$ (Pa) | | | | |
| 0.1 | 1.5 | 3.5 | 6.2 | 7.8 | 15 |
| 0.5 | 1.2 | 3.0 | 5.8 | 7.9 | 20 |
| 1.0 | 1.6 | | 6.1 | 8.6 | 20 |

Yield Stress Values for an $Al_2O_3$ Suspension with Soy Protein.

| | 20% $Al_2O_3$ in Silicone Oil, SP Added | | | | |
|---|---|---|---|---|---|
| | Electric Field Strength (V/mm) | | | | |
| SP wt % | 0 | 500 | 1000 | 1200 | 1400 |
| | $\tau_o$ (Pa) | | | | |
| 0.2 | 0.6 | 1.0 | 1.2 | 2.5 | 6.5 |
| 0.5 | 0.30 | | 0.5 | 0.9 | 1.0 |
| 0.3 | 0.3 | | 1.3 | 1.0 | 1.3 |

Yield Stress Values for an $Al_2O_3$ Suspension with KC.

| | 20% $Al_2O_3$ in Silicone Oil, KC Added | | | | |
|---|---|---|---|---|---|
| | Electric Field Strength (V/mm) | | | | |
| KK wt % | 500 | 1000 | 1200 | 1300 | 1400 |
| | $\tau_o$ (Pa) | | | | |
| 0.05 | 1.6 | 5.3 | 8.4 | 9.0 | 10 |
| 0.1 | 2.0 | 8.8 | 5.4 | 10 | 11 |
| 0.2 | 3.0 | 7.0 | 12 | 11 | 15 |
| 0.4 | 6.7 | 5.0 | 11 | 12 | |

Yield Stress Values for an $Al_2O_3$ Suspension with AC.

| | 20% $Al_2O_3$ in Silicone Oil, AC Added | | | |
|---|---|---|---|---|
| | Electric Field Strength (V/mm) | | | |
| AK wt % | 500 | 750 | 1000 | 1500 |
| | $\tau_o$ (Pa) | | | |
| 0.05 | 0.27 | 0.59 | 1.0 | 1.9 |
| 0.1 | 1.4 | 1.5 | 1.1 | 3.1 |
| 0.2 | 4.9 | 1.3 | 2.5 | 4.0 |

-continued

| | 20% $Al_2O_3$ in Silicone Oil, AC Added | | | |
|---|---|---|---|---|
| | Electric Field Strength (V/mm) | | | |
| AK wt % | 500 | 750 | 1000 | 1500 |
| | $\tau_o$ (Pa) | | | |
| 0.4 | 4.3 | 5.0 | 8.0 | 11 |

Conclusion: Enhancer effect works for a wide variety of proteins.

Example 5: Yield Stress Values for a Zeolite Suspension with BLG: AB1.

| | Electric Field Strength (V/mm) | | | | | |
|---|---|---|---|---|---|---|
| | 0 | 500 | 1000 | 1200 | 1400 | 1500 |
| | $\tau_o$ (Pa) | | | | | |
| BLG wt % | 20% Zeolite in Silicone Oil, BLG Added | | | | | |
| 0 | 1.3 e-2 | 1.5 | 6.5 | 7.2 | 9.0 | 10 |
| 0.1 | 2.0 e-2 | 1.8 | 6.4 | 8.0 | 9.0 | 10 |
| 0.3 | 6.3 e-3 | 1.5 | 6.1 | 8.2 | 10 | 10 |
| AB1 wt % | 20% Zeolite in Silicone Oil, AB1 Added | | | | | |
| 0.1 | 6.0 e-2 | 1.6 | 5.6 | 7.0 | 7.8 | 8.5 |
| 0.2 | 8.0 e-2 | 1.6 | 6.3 | 7.0 | 9.0 | 10 |
| 0.5 | 5.0 e-2 | 1.6 | 5.6 | 6.4 | 7.0 | 8.3 |

Conclusion: Enhancer effect works for other porous particles.

Example 6: Yield Stress Values for a Zeolite Suspension with BLG, and Water.

| | 20% Zeolite in Silicone Oil, BLG and 0.5% Water Added | | | | |
|---|---|---|---|---|---|
| | Electric Field Strength (V/mm) | | | | |
| BLG wt % | 0 | 500 | 1000 | 1200 | 1500 |
| | $\tau_o$ (Pa) | | | | |
| 0.2 | 6.0 e-2 | 2.5 | 14 | 31 | 40 |

Conclusion: Water effect is not limited to the specific particle.

Example 7: Yield Stress Values for 20 wt % $Al_2O_3$ Suspension with Water.

| 20% $Al_2O_3$ in Silicone Oil, 0.5% Water Added | | | |
|---|---|---|---|
| Electric Field Strength (V/mm) | | | |
| 0 | 500 | 1000 | 1200 |
| $\tau_o$ (Pa) | | | |
| 1.0 e-2 | 2.2 | 5.6 | 5.5 |

| 20% $Al_2O_3$ in Silicone Oil, 0.4% Water and 0.1% BLG | | | |
|---|---|---|---|
| Electric Field Strength (V/mm) | | | |
| 0 | 500 | 750 | 1000 |
| $\tau_o$ (Pa) | | | |
| 2.8 e-2 | 4.2 | 9.0 | 15 |

Conclusion: The ER effect is multiplied through use of the protein enhancer.

Example 8: Yield Stress Values for 20 wt % Aluminum Suspension with 0.34% BLG at 1400 V/mm and various frequencies.

| f (Hz) | $\tau_o$ (Pa) |
|---|---|
| 200 | 7.0 |
| 400 | 3.8 |
| 500 | 3.3 |
| 600 | 2.8 |
| 800 | 2.1 |

Conclusion: Relatively low frequency is preferred.

Example 9: Yield Stress Values for 10 wt % Fly Ash Suspension.

| | 10% Fly Ash in Silicone Oil, BLG Added | | | | | |
|---|---|---|---|---|---|---|
| | Electric Field Strength (V/mm) | | | | | |
| BLG wt % | 0 | 500 | 1000 | 1200 | 1400 | 1500 |
| | $\tau_0$ (Pa) | | | | | |
| 0 | 7.2 e-2 | 1.4 e-2 | 8.0 e-3 | 4.0 e-3 | 0.19 | 3.0 e-2 |
| 0.2 | 5.0 e-2 | 5.0 e-2 | 2.1 e-2 | 1.0 e-2 | 1.0 e-2 | 1.0 e-2 |

Conclusion: Effect is not exhibited for non-porous particles.

Discussion

It can therefore be seen that the addition of small amounts of proteins greatly enhanced the ER response. Lower yield stresses were observed at higher frequencies.

Casein was the most difficult protein to disperse. On many occasions, visible strands of casein were present in the suspension. Therefore, part of the enhancement of the ER response for casein might be attributable to the mechanical entanglement of the particle columns and casein strands. For the other proteins, the dispersion was much more uniform and this type of mechanical effect was not observed.

Importantly, the protein solution by itself (in oil, without porous particles) is not an ER fluid. We believe that this is because the size of proteins is too small. Proteins affect the ER response only in the presence of larger particles. Moreover, only porous particles seem to exhibit the effect. When using the variant where the protein is not preimbedded in the pores, we believe that proteins nevertheless adsorb on the particle surfaces and pores. The protein adsorption then changes the interfacial polarizability of the particles, hence affecting the ER response.

With respect to the effect of water, since proteins are hydrophilic, they are capable of carrying water molecules to the particle surfaces. This likely further enhances the interfacial polarizability.

In some experiments, we attempted to prepare water free samples. However, absorption of water through air and protein strands into the solution may have been a factor in these experiments as well. Permitting a small amount of additional water to the suspension clearly enhanced the ER response.

The zeolite particles, while enhanced, did not show as much enhancement as aluminum oxide particles. Both particles are in the same diameter range. However, the aluminum oxide particles have larger pores. This is further evidence of the importance of the pores.

The milk protein beta-Lactoglobulin, is readily available at low cost. It is also known to strongly interact with high valence ions. In general, milk proteins interact strongly with the calcium ion, an ion that carries a valence of +2. See P. F. Fox (editor), "Developments In Dairy Chemistry -1" Applied Science Publishers (1982). We believe that the best proteins for enhancement will be complex proteins designed by evolutionary pressures to optimize interactions with high valence ions. In this regard, polarization is the product of "shift in ion location" times "charge per ion". By "interact" we mean strong binding or strong association.

Although the present invention has been described with reference to certain preferred embodiments, other versions are possible. For example, much lower and higher molecular weight polypeptides may be used for the ER enhancer. Also, mixed protein materials (e.g. fusion proteins), and other proteinaceous materials are to be considered to be proteins. Also, many other types of porous particle may be used (e.g. the pre-imbedded protein variant). Moreover, the protein can be one of several enhancers added to the ER fluid. It need not be the only enhancer. Therefore, the scope of the claims should not be limited to just the description of the preferred embodiments herein. The claims should be looked to to judge the full scope of the invention.

We claim:

1. An electrorheological fluid, comprising:

a low conductivity liquid selected from the group consisting of oils and halogenated hydrocarbons;

a protein; and porous particles dispersed in the liquid; wherein:

(a) pores of the particles receive at least a part of the protein with some of the pores having an opening of at least 60 Angstroms, or (b) the protein was pre-imbedded in the particles prior to insertion of the particles in the liquid;

wherein the volume fraction of the particles in the fluid is between 0.05 and 0.50; and wherein the protein is 0.01% to 1% by weight of the fluid, and the fluid is such that an electric potential difference provided across the fluid can increase the viscosity of the fluid to a greater extent than the increase in viscosity would be if the fluid did not contain the protein.

2. The electrorheological fluid of claim 1, wherein the liquid is an oil.

3. The electrorheological fluid of claim 1, wherein the majority of the particles in the fluid have a diameter of between 0.05 μm and 100 μm, and said liquid itself has a viscosity between 0.001 Pa*s and 10 Pa*s.

4. The electrorheological fluid of claim 1, wherein the protein is a casein protein that can bind an ion having a valence of at least +2.

* * * * *